US009845213B2

(12) United States Patent
Segers et al.

(10) Patent No.: US 9,845,213 B2
(45) Date of Patent: Dec. 19, 2017

(54) SHEET DIVERTING UNIT

(71) Applicant: OCE-TECHNOLOGIES B.V., Venlo (NL)

(72) Inventors: Johannes T. H. Segers, Venlo (NL); Jacobus J. Kandelaars, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 103 days.

(21) Appl. No.: 14/947,775

(22) Filed: Nov. 20, 2015

(65) Prior Publication Data

US 2016/0145063 A1 May 26, 2016

(30) Foreign Application Priority Data

Nov. 21, 2014 (EP) ..... 14194297

(51) Int. Cl.
*B65H 5/26* (2006.01)
*B65H 29/58* (2006.01)
(Continued)

(52) U.S. Cl.
CPC ..... *B65H 5/26* (2013.01); *B65H 5/36* (2013.01); *B65H 29/58* (2013.01); *B65H 85/00* (2013.01);
(Continued)

(58) Field of Classification Search
CPC ..... B65H 29/58; B65H 29/585; B65H 29/60; B65H 29/62; B65H 29/64; B65H 85/00;
(Continued)

(56) References Cited

U.S. PATENT DOCUMENTS 5,570,877 A * 11/1996 Asami ..... B65H 29/12 271/186
6,302,392 B1 * 10/2001 Schaefer ..... B65H 29/60 271/186
(Continued)

FOREIGN PATENT DOCUMENTS

EP 2546001 A1 * 1/2013 ..... B07C 3/065
JP 3-31162 A 2/1991
(Continued)

*Primary Examiner* — Ernesto A Suarez
(74) *Attorney, Agent, or Firm* — Birch, Stewart, Kolasch & Birch, LLP

(57) ABSTRACT

The present invention provides a sheet diverting unit for selectively diverting a sheet towards a first receiving path or a second receiving path, comprising an inlet path for advancing a sheet in a sheet supply direction towards a diverter; the diverter comprising a shaft, a deflector being connected to said shaft and extending between said shaft and a tip, and an actuator arranged for rotating the shaft thereby selectively pivoting the deflector between a first deflector position for directing the sheet into the first receiving path and a second deflector position for directing the sheet into the second receiving path; said deflector comprising a guiding edge and a second edge, said second edge arranged facing a second trajectory to the second receiving path in the second deflector position for directing the sheet into the second receiving path and said guiding edge arranged facing a straight first trajectory to the first receiving path thereby said guiding edge facing a guiding element in the first deflector position for guiding the sheet into the first receiving path; wherein the guiding edge comprises a recess portion, wherein the recess portion is arranged inwardly away from the straight first trajectory to the first receiving path when the deflector is arranged in the first deflector position, wherein the recess portion is arranged for extending substantially from the
(Continued)

guiding element towards the shaft when the deflector is arranged in the second deflector position.

16 Claims, 5 Drawing Sheets

(51) Int. Cl.
*B65H 85/00* (2006.01)
*B65H 5/36* (2006.01)

(52) U.S. Cl.
CPC ..... *B65H 2301/445* (2013.01); *B65H 2404/52131* (2013.01); *B65H 2404/632* (2013.01); *B65H 2511/16* (2013.01); *B65H 2511/17* (2013.01); *B65H 2601/2525* (2013.01); *B65H 2801/06* (2013.01)

(58) Field of Classification Search
CPC .... B65H 2301/3124; B65H 2301/3125; B65H 2301/333; B65H 2301/331; B65H 2301/3312; B65H 2404/512; B65H 2404/521; B65H 2404/5213; B65H 2404/52131; B65H 2404/5124; B65H 2404/62; B65H 2404/622; B65H 2404/6221; B65H 2404/623; B65H 2404/63; B65H 2404/632; B65H 2404/7414; B65H 2601/2531
See application file for complete search history.

(56) References Cited

U.S. PATENT DOCUMENTS

| | | | | |
|---|---|---|---|---|
| 6,398,212 | B1 * | 6/2002 | Miyake | G03G 15/231 271/186 |
| 7,055,820 | B2 * | 6/2006 | Saito | B65H 29/60 271/298 |
| 7,954,622 | B2 * | 6/2011 | Schimmel | B65G 47/82 198/367.1 |
| 8,167,304 | B2 * | 5/2012 | Fukazawa | B65H 29/58 271/225 |
| 8,231,126 | B2 * | 7/2012 | Shimonaga | B41J 3/60 271/186 |
| 8,382,098 | B2 * | 2/2013 | Gao | B65H 5/062 271/186 |
| 9,053,597 | B1 * | 6/2015 | Sackfield | B65H 29/58 |
| 2013/0248322 | A1 | 9/2013 | Okamoto et al. | |

FOREIGN PATENT DOCUMENTS

| | | | |
|---|---|---|---|
| JP | 2000-136059 | A | 5/2000 |
| JP | 1 249 738 | A2 | 10/2002 |
| JP | 2005-178954 | A | 7/2005 |

* cited by examiner

SHEET DIVERTING UNIT

FIELD OF THE INVENTION

The present invention relates to a sheet diverting unit for selectively diverting a sheet. The present invention further relates to a printing system for printing on a sheet comprising a sheet diverting unit according to the present invention. The present invention further relates to a sheet handling device for transporting a sheet comprising a sheet diverting unit according to the present invention.

BACKGROUND ART

A known productive printing apparatus for printing on cut sheets comprises a printing station for applying an image on both sides of said cut sheet, a sheet input station for storing cut sheets to be printed, a sheet output station for collecting processed cut sheets and a sheet transport path arranged for advancing cut sheets throughout the printing apparatus. Said sheet transport path may be arranged for in a simplex printing mode selectively moving cut sheets from said sheet input station along the printing station, which prints a first image on the cut sheet, towards the sheet output station. Alternatively said sheet transport path may be arranged for in a duplex printing mode selectively after printing the first image circulating the cut sheet along a circulating duplex path back to the printing station for printing a second image on another side of the cut sheet opposite to the first image.

A sheet diverting unit may be arranged downstream of the printing station for selectively diverting a sheet towards a first receiving path, such as said circulating duplex path, or towards a second receiving path, such as an output path towards the sheet output station. The sheet diverting unit comprises an inlet path for advancing a sheet in a sheet supply direction towards a diverter. The diverter comprising a shaft, a deflector being connected to said shaft and extending between said shaft and a tip. Said actuator is arranged for rotating the shaft thereby selectively pivoting the deflector between a first deflector position for directing the sheet into the first receiving path and a second deflector position for directing the sheet into the second receiving path. The deflector comprises a curved edge and a guiding edge, said curved edge arranged facing a second trajectory to the second receiving path in the second deflector position for deflecting the sheet into the second receiving path and said guiding edge arranged facing a first trajectory to the first receiving path in the first deflector position for guiding the sheet into the first receiving path, such as a straight path or straight first trajectory arranged in line with inlet path.

To achieve higher productivity in printing cut sheets a demand exists for reducing a inter sheet gap (or free distance) between successive sheets advancing in the sheet transport path. Similar to the free distance a free distance time, which is a time between a trailing edge of an outgoing sheet and a leading edge of a subsequent sheet, may be reduced. As the free distance between successive sheets is reduced the diverter of the sheet diverting unit needs to switch faster between the first deflector position and the second deflector position. However faster switching, i.e. faster pivoting of the deflector, may lead to uncontrolled positioning of the deflector in the first deflector position and in the second deflector position. Furthermore the outgoing sheet may become damaged at a trailing edge by a fast switching deflector.

SUMMARY OF THE INVENTION

It is accordingly an object of the present invention to provide a sheet diverter unit for increasing the productivity of cut sheets in a transport path by supporting a shorter free distance between successive sheets and/or support a shorter free distance time between successive sheets.

The present invention provides a sheet diverting unit for selectively diverting a sheet towards a first receiving path or a second receiving path, comprising: an inlet path arranged for advancing a sheet in a sheet supply direction towards a diverter; the diverter comprising a shaft, a deflector being connected to said shaft and extending between said shaft and a tip, and an actuator arranged for rotating the shaft thereby selectively pivoting the deflector between a first deflector position for directing the sheet into the first receiving path and a second deflector position for directing the sheet into the second receiving path; said deflector comprising a guiding edge and a second edge, said second edge arranged facing a second trajectory to the second receiving path in the second deflector position for directing the sheet into the second receiving path and said guiding edge arranged facing a straight first trajectory to the first receiving path thereby said guiding edge facing a guiding element in the first deflector position for guiding the sheet into the first receiving path characterized in that the guiding edge comprises a recess portion, the recess portion being arranged inwardly away from the straight first trajectory to the first receiving path when the deflector is arranged in the first deflector position, wherein the recess portion is arranged for extending substantially from the guiding element towards the shaft when the deflector is arranged in the second deflector position.

The recess portion of the guiding edge is shaped for guiding the sheet into the first receiving path in the first deflector position. The recess portion further provides a cavity in the straight first trajectory to the first receiving path in the second deflector position, which recess portion is arranged for extending substantially from the guiding element, such as a baffle, towards the shaft, thereby providing space for a shorter free distance between successive sheets. As defined herein the recess portion extending substantially from the guiding element towards the shaft when the deflector is arranged in the second deflector position means that the recess portion extends over at least a part of a width of the first trajectory, wherein the recess portion is arranged for allowing a trailing edge of an outgoing sheet, which is present in the straight first trajectory, to advance further along the straight first trajectory to the first receiving path. As such, the recess portion is suitably arranged proximate to the guiding element or intersecting the guiding element, while extending over at least a part of the width of the first trajectory. In this way, the outgoing sheet is not obstructed or damaged by the guiding edge of the deflector when the deflector is moved from the first deflector position to the second deflector position when said outgoing sheet is still in the straight first trajectory to the first receiving path.

The recess portion may extend from the guiding element over a part of the width of the first trajectory to the first receiving path or may extend over the entire width of the first trajectory to the first receiving path when the deflector is arranged in the second deflector position. The width of the straight first trajectory is defined as being lateral to the advancing direction of the sheet along the first trajectory.

Additionally, the recess portion may be arranged for additionally extending outside the width of the first trajectory, thereby protruding the guiding element towards the tip when the deflector is arranged in the second deflector position.

The outgoing sheet in the first trajectory to the first receiving path may have a trailing edge present facing the guiding edge, while the deflector is already switched into the second deflector position for directing a subsequent sheet into a second receiving path. Thus the recess portion according to the present invention provides a cavity for accommodating the trailing edge of the outgoing sheet, thereby allowing a shorter free distance between successive sheets by allowing an earlier switching of the deflector into the second deflector position.

The recess portion may have an acute angle with respect to a downstream portion of the guiding edge arranged downstream of the recess portion, wherein said acute angle is selected to be at most a maximum acute angle, such as 15°, for controllably guiding the sheet along guiding edge. As a result a leading edge of the sheet which is curved towards the guiding edge is reliably guided along the guiding edge. Said downstream portion of the guiding edge is preferably arranged substantially parallel to the straight first trajectory to the first receiving path.

The recess portion may have a concave shape curved inward away from the straight first trajectory to the first receiving path, may have a tapered shape arranged away from the straight first trajectory to the first receiving path, and may have any other shape suitable for allowing an outgoing sheet advancing along the shaft.

In a particular example of the recess portion, an upstream part of the recess portion has an upstream acute angle away from the first receiving path being steeper than a downstream part of the recess portion having a downstream acute angle towards the first receiving path. The upstream part of the recess portion in the sheet transport direction may for example have an angle of about 45°-90° away from the first receiving path in the first deflector position.

In an embodiment, the recess portion is arranged for providing a cavity in the straight first trajectory to the first receiving path, wherein the cavity is arranged for accommodating a trailing edge of an outgoing sheet when the deflector is arranged in the second deflector position, thereby allowing a reduction in distance between successive sheets. The cavity in the straight first trajectory to the first receiving path in the second deflector position allows and does not obstruct the outgoing sheet, in particular a trailing edge of the outgoing sheet, advancing in the first trajectory to the first receiving path. As a result the trailing edge of the outgoing sheet is not damaged by the guiding edge of the deflector in the second deflector position and a shorter free distance between successive sheets is supported.

In an embodiment, wherein the second edge is a curved edge arranged for deflecting the sheet into the second receiving path. This embodiment supports a second receiving path which is arranged in an arched direction away from the sheet supply direction. This may be useful for selectively splitting off sheets from a main transport path continuing in the sheet supply direction. The second receiving path in this embodiment may for example be part of a circulating path, such as a duplex path, and may be part of an error sheet removal path.

In an embodiment, the guiding element is a baffle. A baffle is a common guiding element for guiding the sheet along a transport path or trajectory. The baffle may be suitable shaped in a straight direction for guiding the sheet along the first trajectory to the first receiving path. The baffle may comprise a hole for receiving a portion of the deflector, e.g. the tip of the deflector, when the deflector is arranged in the second deflector position. In this way, the baffle allows the deflector to be moved towards a second deflector position wherein the deflector partially protrudes the baffle. As such, the receiving hole supports a reliable guiding of the sheets towards the first receiving path.

In an embodiment, said guiding edge comprises a straight portion, which is arranged substantially parallel to the guiding element of the straight first trajectory to the first receiving path when the deflector is arranged in the first deflector position. The recess portion is curved inwardly away from the straight direction of the first trajectory to the first receiving path and/or is curved inwardly away from the straight portion of the guiding edge.

In an embodiment, the straight portion of guiding edge and the straight first trajectory to the first receiving path are arranged substantially parallel to the sheet supply direction. In this embodiment the sheet is guided along the first trajectory into the first receiving path without deflecting the sheet as such, thereby minimizing loads on the deflector. In a particular example, the first trajectory to the first receiving path is arranged in line to the inlet path.

In an embodiment, the recess portion is shaped having an acute angle being not larger than 15° with respect to the first trajectory to the first receiving path when the deflector is arranged in the first deflector position. The acute angle of the recess portion towards the first trajectory to the first receiving path being not larger than 15° supports a reliable guiding of a leading edge of the sheet into the first receiving path in the first deflector position. In case the angle is larger than 15° a leading edge of the sheet may be obstructed by the recess portion, for example in case of a leading edge curling towards the guiding edge of the deflector.

In an embodiment, the tip comprises a front edge arranged at an acute angle being at most 30° with respect to the guiding edge. The acute angle of the front edge being at most 30° supports a guiding of the sheet into the first receiving path in the first deflector position.

In an embodiment, the diverter of the sheet diverting unit comprises a plurality of deflectors distributed along an axial direction of the shaft, each deflector comprising said guiding edge arranged facing the first trajectory to the first receiving path in the first deflector position for guiding the sheet into the first receiving path, wherein the guiding edge comprises said recess portion. The plurality of deflectors supports a relative light weight and fast switchable diverter between the second deflector position and first deflector position.

In an embodiment, each deflector has a first side surface and a second side surface arranged at both sides of the deflector in an axial direction of the shaft, wherein both first and second side surfaces of at least one of the plurality of deflectors is arranged at an acute angle away from the sheet supply direction. The axial direction of the shaft is arranged substantially perpendicular to the sheet supply direction. The acute angle of both the first and second side surfaces supports guiding of side edges of the sheet in the sheet supply direction along the diverter. The side edges of the sheet do not get obstructed at the side surfaces of the deflector even in case of small lateral movements in the axial direction perpendicular to the sheet supply direction.

In an embodiment, a first acute angle of said first side surface is smaller than a second acute angle of said second side surface facing towards an end of the shaft in the axial direction. In this embodiment the guide edge is a tapered edge from the tip to the shaft in the sheet supply direction. This shape supports a fast switchable deflector providing proper guiding of the sheet along the shaft.

In an embodiment, the guiding edge is arranged along the shaft at a distance between the guiding edge and the shaft, which is at least a predetermined distance for guiding the sheet away from the shaft. The predetermined distance from the shaft is selected such that a leading edge and/or a corner of the sheet is guided away from the shaft. As a result a reliable guidance of the sheet along the shaft is obtained. The predetermined distance may be for example 5 mm. The predetermined distance may be determined based on a distance between adjacent deflectors in the axial direction of the shaft.

In an embodiment, the curved edge has a radius of at least 100 mm. In this embodiment the sheet is deflected into the second receiving path thereby minimizing loads on the deflector during deflection of the sheet. This supports a smaller size and/or weight of the deflector and especially a smaller size and/or weight of the tip of the deflector. The relative light weight deflector supports a fast switchable diverter between the first deflector position and second deflector position.

In another aspect of the present invention a printing system is provided for printing on a sheet comprising a transport path for transporting said sheet along a printing station arranged for printing on said sheet, said transport path comprising a sheet diverting unit according to the present invention.

In another aspect of the present invention a sheet handling device is provided comprising a transport path for transporting successive sheets through the sheet handling device, said transport path comprising a sheet diverting unit according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1A:
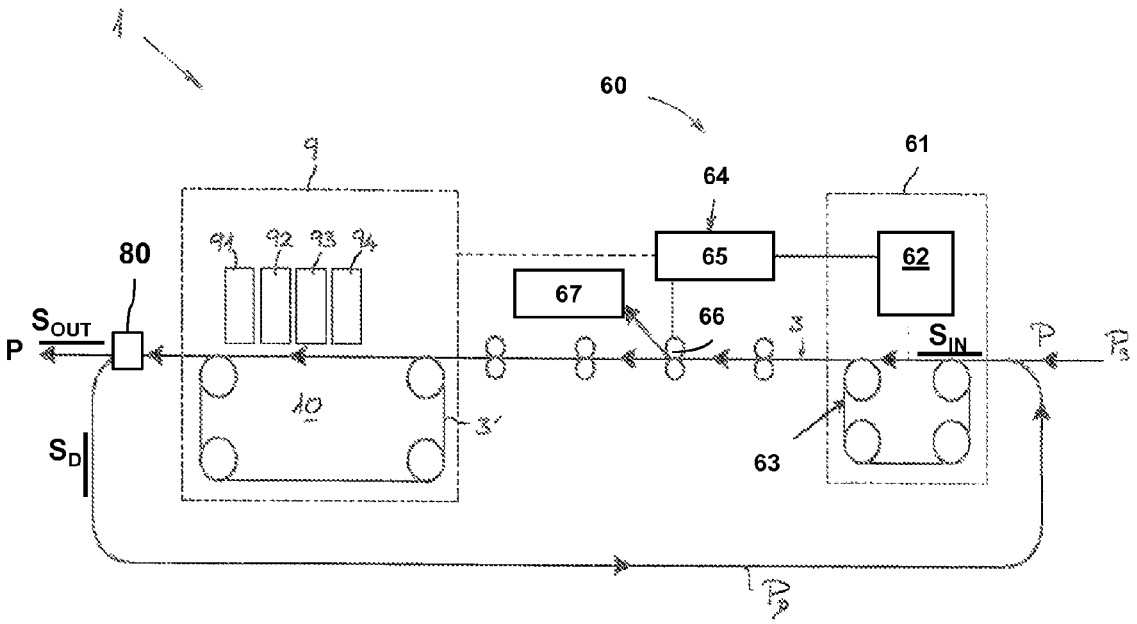
FIG. 1A shows a schematic view of an inkjet printing system in which a sheet diverting unit according to the present invention may be used.

The present invention will now be described with reference to the accompanying drawings, wherein the same reference numerals have been used to identify the same or similar elements throughout the several views.

Referring to FIG. 1A a inkjet printing system 1 is shown including an image forming device or inkjet marking module 9, where image formation is carried out by ejecting ink from inkjet marking device 91, 92, 93, 94 arranged so that a whole width of a sheet S is covered. That is, the image forming device 9 comprises an inkjet marking module having four inkjet marking devices 91, 92, 93, 94, each being configured and arranged to eject an ink of a different color (e.g. Cyan, Magenta, Yellow and Black). Such an inkjet marking device 91, 92, 93, 94 for use in single-pass inkjet printing typically has a length corresponding to at least a width of a desired printing range, with the printing range being perpendicular to the media transport direction along the transport path P.

In this regard, it will be noted that the printing system 1 in FIG. 1A has a transport path P which includes both a simplex path $P_S$ and a duplex path $P_D$. A sheet diverting unit 80 is arranged at the parting position of the simplex path $P_S$ and the circulating duplex path $P_D$ downstream of the image forming device 9, which sheet diverting unit 80 is arranged for diverting a sheet being processed in the image forming device 9 selectively to either the output path as shown for a sheet $S_{OUT}$ or to the circulating duplex path $P_D$ for a duplex sheet $S_D$. Said sheet diverting unit 80 may for example be the sheet diverting unit according to the present invention.

Said inkjet printing system 1 further includes an apparatus 60 for detecting defects in the printing system 1, and particularly for identifying and for classifying deformations D in the sheets S of print medium when the sheets S are on the transport path P of the printing system 1. In this particular inkjet printing system, the apparatus 60 comprises a sensing unit 61, which processes the sheets $S_{IN}$ on the transport path P before those sheets $S_{IN}$ enter the image forming device 9. The sensing unit 61 of the apparatus 60 is arranged such that sheets S input on the simplex path $P_S$ and also returning on the duplex path $P_D$ all pass via the sensing unit 61.

At least one first sensor device 62 in the form of an optical sensor, such as a laser scanner, is provided within the sensing unit 61 for sensing the surface geometry or topology of the sheets S as they travel on a first pass or a second pass along the transport path P. The laser scanner or optical sensor device 62 generates digital image data I of the three-dimensional surface geometry or topology of each sheet S sensed or scanned. When performing the sensing or measuring of the surface geometry or topology of the sheets S on the transport path P of printing system 1 with the first sensor device(s) 62, it is highly desirable for the purposes of accuracy and reliability that the sheets S are transported or conveyed in the sensing unit 61 in substantially the same manner as those sheets S are later transported in the image forming unit or marking module 9. To this end, the sensing unit 61 includes a sheet conveyor mechanism 63 that simulates the sheet transport conditions provided by the transport mechanism 3' within the image forming unit 9. In this regard, both the conveyor mechanism 63 and the transport mechanism 3' include a belt transport device with vacuum sheet-holding pressure, as seen in FIG. 1A.

The sheet topology data from the first sensor device 62 is then transmitted (e.g. either via a cable connection or wirelessly) to a controller 64 which includes a processor device 65 for processing and analyzing the digital image data I to detect and to classify any defect or deformation D in the surface geometry or topology of each sheet S sensed or scanned. The sensing unit 61 is thus arranged to scan the sheets S for detecting and measuring any deformations or defects D before the sheets S enter the image forming device or inkjet marking module 9. In this way, if the processor device 65 determines that a sheet S on the transport path P includes a defect or deformation D that would render the sheet unsuitable for printing, the controller 64 is configured to prevent the sheet S from progressing to the inkjet marking module 9. The sensing unit 61 comprising the first sensor device(s) 62 is therefore desirably provided as a separate sentry unit positioned on the transport path P sufficiently upstream of the marking module 9.

After the image data I has been analyzed by the processor 65 and the defects or deformations D within the sheet S have been extract and classified accordingly, the controller 64 may transmit a control signal (either via cable or wirelessly) to a removal device or ejector device 66 for regulating the transport or conveyance of the sheets S to the image forming device or inkjet marking module 9. In particular, if the sheet S has been determined by the processor 65 to include one or more deformations D with a size or extent above a predetermined threshold sufficient to render the sheet unsuitable for printing, the controller 64 is configured to control or operate the removal device 66 to remove or eject the sheet S from the transport path P to a reject tray 67. In this way, sheet jams within the print module or image forming device 9 may be avoided when sheets S are found to contain too much deformation. The removal device 66 located between the sentry unit 61 and the inkjet marking module 9 can employ different means optimized for redirecting the sheets S from the transport path P towards the reject tray 67.

In particular the removal device 66 may employ a sheet diverting unit according to the present invention, wherein a first receiving path may be the advancing transport path towards the image forming device 9 and wherein a second receiving path may be an arched outlet path deflecting away from the transport path P towards the reject tray 67.

Figure 2A:
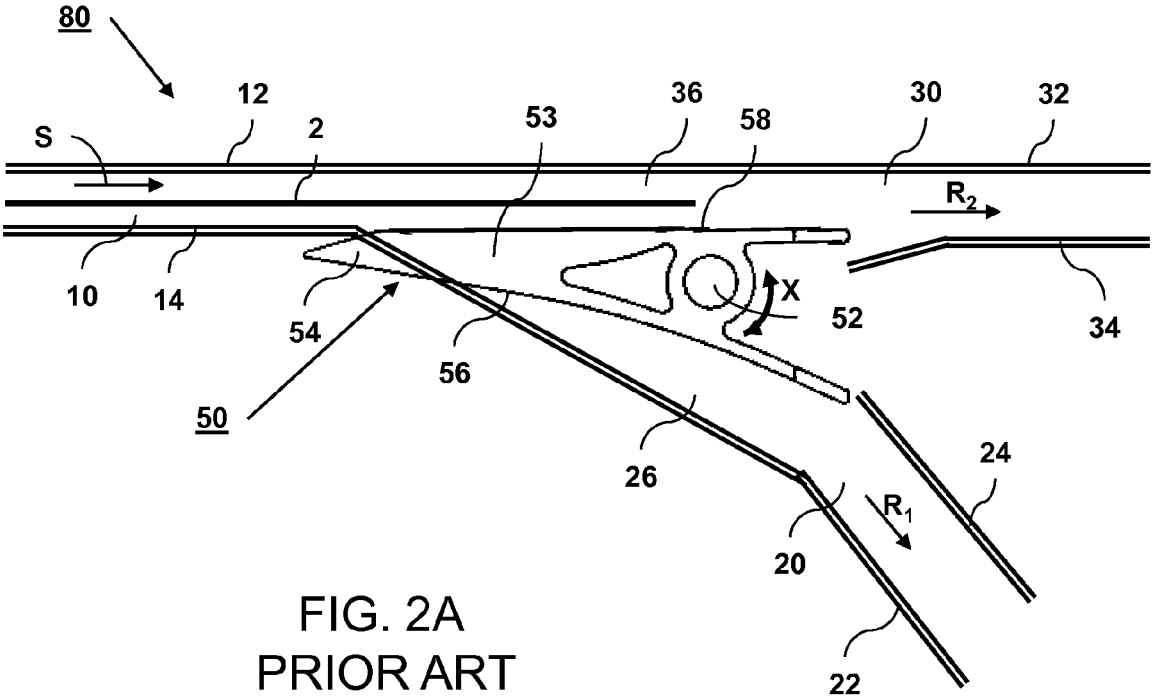
FIG. 2A PRIOR ART
FIGS. 2A-2C show a sheet diverting unit comprising a diverter known in the prior art.

In FIG. 2A a prior art sheet diverting unit 80 is shown comprising an inlet path 10 for advancing a sheet 2*a* in a sheet supply direction S towards a diverter 50. Said inlet path 10 comprises baffles 10, 12 arranged at both sides of the inlet path 10 for guiding the cut sheet 2*a* towards said diverter 50. The diverter 50 may be selectively arranged for diverting the sheet 2*a* towards a second receiving path 20 as indicated by arrow $R_1$, such as said circulating duplex path, or towards a first receiving path 30 as indicated by arrow $R_2$, such as an output path towards the sheet output station. The diverter 50 comprising a shaft 52 being arranged in an axial direction perpendicular to the plane of viewing, a deflector 53 being connected to said shaft 52 and extending between said shaft 52 and a tip 54. Said tip 54 is arranged towards the inlet path 10 upstream of the shaft 52 relative to the sheet transport direction S.

An actuator (not shown) is arranged for rotating the shaft along arrow X thereby selectively pivoting the deflector between a second deflector position for directing the sheet 2*a* into the second receiving path 20 and a first deflector position, as is shown in FIG. 2A, for directing the sheet 2*a* into the first receiving path 30. The second receiving path 20 comprises baffles 22, 24 arranged at least in part at both sides of the second receiving path 20 for guiding the sheet 2 along the second receiving path 20. The first receiving path 30 comprises baffles 32, 34 arranged at least in part at both sides of the first receiving path 30 for guiding the sheet 2 along the first receiving path 30.

The deflector 53 comprises a curved edge 56 and a guiding edge 58. Said curved edge 56 is arranged facing a second trajectory 26 to the second receiving path 20 in the second deflector position (as is also shown in FIG. 2C) for deflecting the sheet 2 into the second receiving path 20. Said guiding edge 58 is arranged facing a first trajectory 36 to the first receiving path 30 in the first deflector position, as is shown in FIG. 2A and in FIG. 2B, for guiding the sheet 2*a*, 2*b* along the first trajectory into the first receiving path 30, for example a straight path or first trajectory 36 arranged in line with inlet path 10 as is shown in FIG. 2A.

The guiding edge 58 is shaped substantially straight and is arranged in the first deflector position substantially parallel to the first trajectory 36 to the first receiving path 30. As long as the outgoing sheet 2*b* advancing in the first receiving path 30 is facing the first trajectory 36 to the guiding edge 58 said diverter 50 may not be switched towards a second deflector position as the guiding edge 58 may damage or hinder a trailing edge of the sheet 2 from advancing in the first receiving direction $R_2$.

Figure 2B:
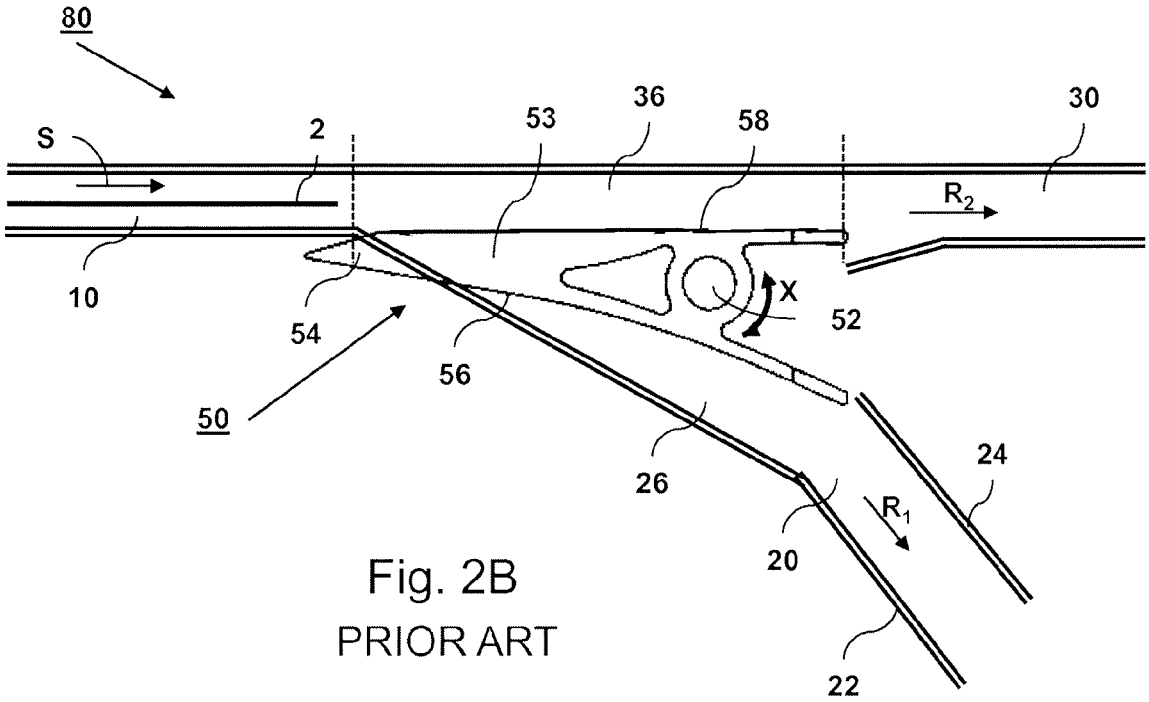
Fig. 2B PRIOR ART
Figure 2C:
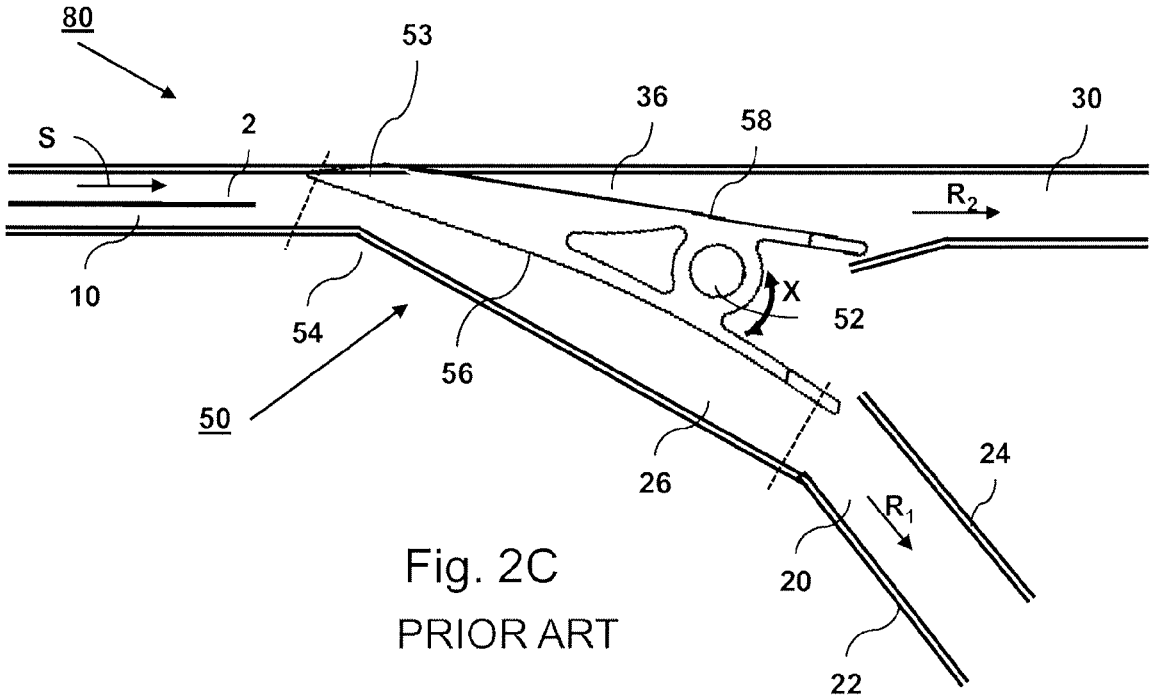
Fig. 2C PRIOR ART

In FIG. 2B schematically is shown the first trajectory 36 to the first receiving path 30. The first trajectory 36 extends along the guiding edge 58 of the deflector 53, as is indicated by the dotted lines, between the inlet path 10 and the first receiving path 30, when the deflector 53 is arranged in the first deflector position.

In FIG. 2C schematically is shown the second trajectory 26 to the second receiving path 20. The second trajectory 26 extends along the curved edge 56 of the deflector 53 as is indicated by the dotted lines between the inlet path 10 and the second receiving path 20, when the deflector 53 is arranged in the second deflector position.

Figure 3A:
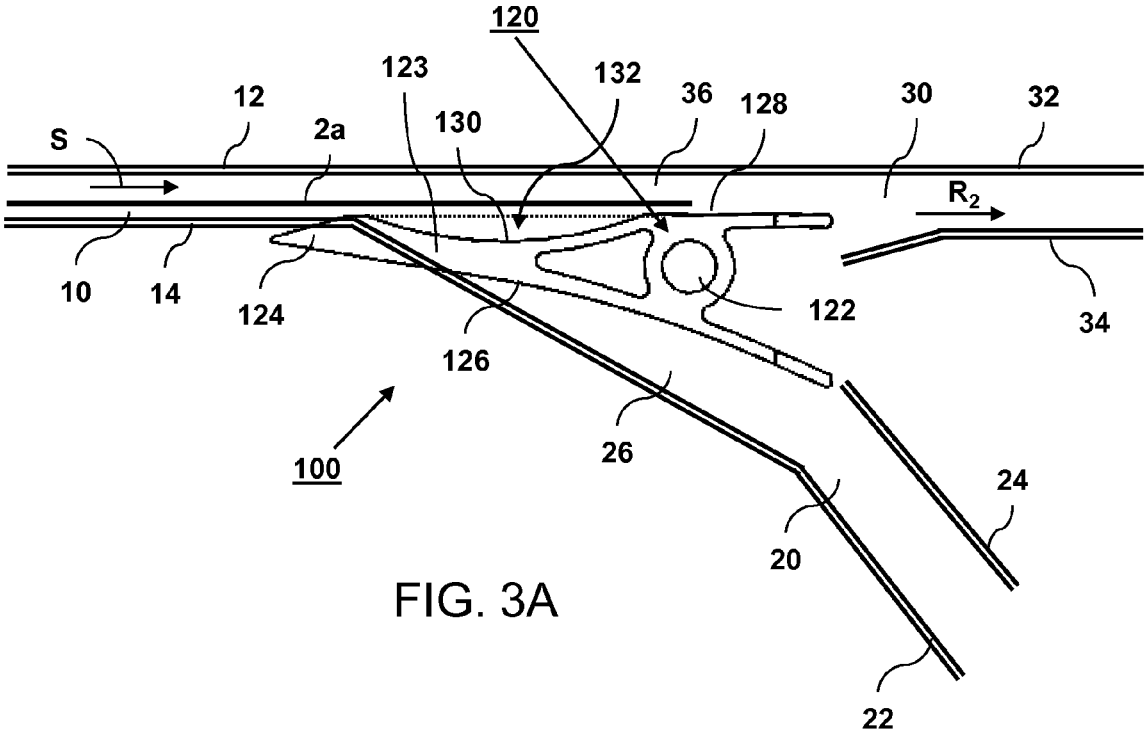
FIGS. 3A-3B show a side view of a sheet diverting unit according to an embodiment of the present invention in respectively a first deflector position and a second deflector position.
Figure 3B:
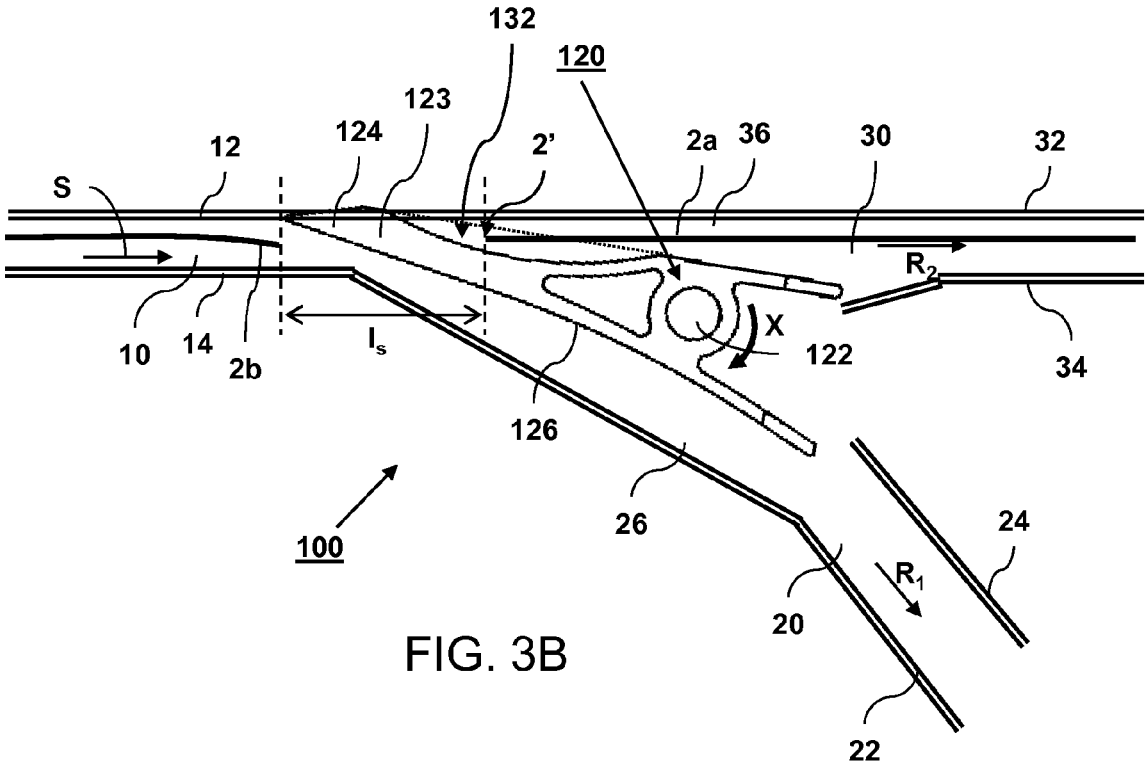

FIGS. 3A-3B show a side view of a sheet diverting unit according to an embodiment of the present invention in respectively a first deflector position and a second deflector position. The sheet diverter unit 100 comprises a diverter 120, which comprises a shaft 122 being arranged in an axial direction perpendicular to the plane of viewing, a deflector 123 being connected to said shaft 122 and extending between said shaft 122 and a tip 124. Said tip 124 is arranged towards the inlet path 10 upstream of the shaft 122 relative to the sheet transport direction S.

An actuator (not shown) is arranged for rotating the shaft 122 along arrow X thereby selectively pivoting the deflector 123 between a second deflector position (as shown in FIG. 3B) for directing the sheet 2 into the second receiving path 20 and a first deflector position (as is shown in FIG. 3A) for directing the sheet 2 into the first receiving path 30. The deflector 123 comprises a curved edge 126 and a guiding edge 128. Now referring to FIG. 3B said curved edge 126 is arranged facing a second trajectory 26 to the second receiving path 20 in the second deflector position for deflecting the sheet 2*b* into the second receiving path 20 as indicated by arrow $R_1$. Said guiding edge 128 is arranged facing a first trajectory 36 to the first receiving path 30 in the first deflector position, as is shown in FIG. 3A, for guiding the sheet 2*a* into the first receiving path 30 as indicated by arrow $R_2$. For example said first trajectory 36 including the first receiving path 30 may be a straight path arranged in line with inlet path 10 as is shown in FIG. 3A.

Figure 3C:
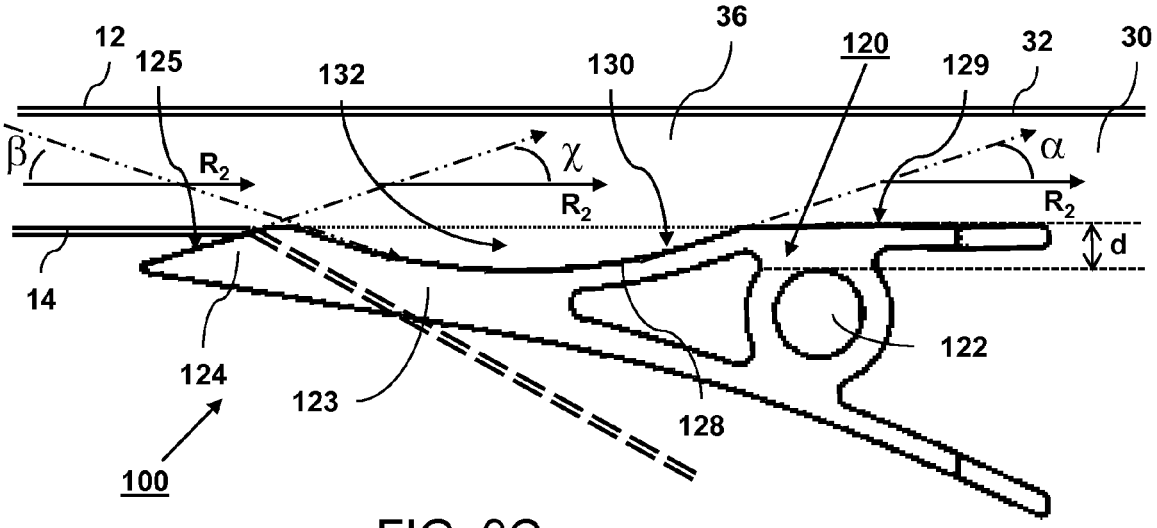
FIG. 3C shows a detailed view of a diverter in the first deflector position of the sheet diverting unit shown in FIG. 3A.

The guiding edge 128 comprises a recess portion 130 which is curved inwardly away from the straight first trajectory 36 to the first receiving path 30. The recess portion 130 of the guiding edge 128 is shaped concavely and provides a cavity 132 in the first trajectory 36 to the first receiving path 30. The cavity 132 provided by the recess portion 130 is an additional space in the first trajectory 36 enclosed as schematically indicated in FIG. 3A-3C by the dotted line and the guidance edge at the recess portion 130. The dotted line indicates a virtual position of a straight guiding edge, such as a guiding edge shown in FIG. 2A, without any recess portion according to the present invention.

Now referring to FIG. 3C a detailed view of the diverter is shown in the first deflector position of the sheet diverting unit shown in FIG. 3A. The recess portion 130 of the guiding edge 128 is shaped concavely and the cavity 132 is indicated by the dotted line and the guidance edge at the recess portion 130. The guiding edge 128 further comprises a portion 129, which is arranged downstream of the recess portion 130, and which portion 129 is arranged substantially parallel to the first trajectory 36 to the first receiving path 30 and substantially parallel to the baffle 32 along the shaft 122 and the first receiving path 30. A sheet advances along the first receiving path 30 in a direction as indicated by $R_2$. The recess portion 130 has an acute angle $\alpha$ with respect to the direction $R_2$ of the sheet in the first receiving path 30, which is at most a maximum angle being 15°. In case the acute angle $\alpha$ is larger than 15°, leading edges of a sheet which are curved towards the guiding edge 128 may become obstructed in the first receiving path 30 due to the acute angle of the recess portion 130.

The guiding edge 128 is arranged at a distance d from the shaft 122 such that any leading edges and/or corners of sheets are guided easily along the shaft 122. Said distance is at least equal to or larger than a predetermined distance for reliable guiding the sheets along the shaft 122 of the diverter 120.

In case of a diverter comprises a plurality of deflectors 123 distributed along an axial direction of the shaft 122 the predetermined distance depends on a distance between adjacent deflectors in the axial direction.

The recess portion 130 may have an upstream part relative to the sheet transport direction S (or direction $R_2$) having an acute angle $\beta$ away from the first receiving path 30. Said acute angle $\beta$ may be steeper than the acute angle $\alpha$, such as between 45° and 90°, as the upstream part of the recess portion does not obstruct any leading edges of sheets moving along the first receiving path 30 in the direction $R_2$.

The deflector 123 shown in FIG. 3C comprises a tip 124, which comprises a front edge 125, wherein said front edge 125 is arranged at an acute angle $\chi$ being at most 30° with respect to the guiding edge 128 and/or the first receiving path 30 in the first deflector position as shown in FIG. 3C. The acute angle of the front edge being at most 30° supports a guiding of the sheet into the first receiving path in the first deflector position. As the front edge 125 is at least partly covered by baffle 14, the angle $\chi$ of the front edge is less critical than the acute angle $\alpha$ of the recess portion 130.

Now referring to FIG. 3B the shaft 122 is rotated to pivot the deflector 123 to the second deflector position wherein a subsequent sheet 2*b* is deflected by the curved edge 126 into the second receiving path 20. At the same time a trailing edge 2' of the outgoing sheet 2*a* in the first trajectory 36 to the first receiving path 30 is not damaged or obstructed by the guiding edge 128 as the recess portion 130 provides space (i.e. by the cavity 132) for accommodating the trailing edge 2' of the outgoing sheet 2*b* inside the first receiving path 30. The recess portion 130 extends from the baffle 32 towards the shaft 122, thereby arranging the cavity 132 extending over at least a part of the width of the first trajectory 36 to the first receiving path 30 from the baffle 32 towards the shaft 122. As a result a free distance $I_S$ between successive sheets 2*a* and 2*b* may be reduced without damaging and/or obstructing the trailing edge 2' of sheet 2*b* inside the first receiving path 30.

Figure 4:
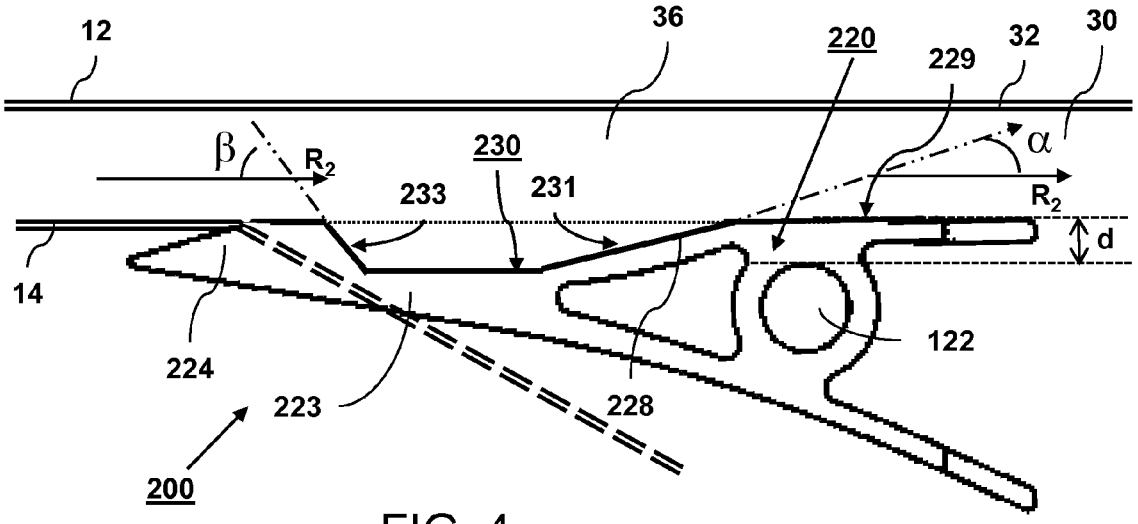
FIG. 4 shows a detailed view of a modified deflector in the first deflector position of a sheet diverting unit according to the present invention.

Now referring to FIG. 4 a detailed view of a modified deflector is shown in the first deflector position of a sheet diverting unit according to the present invention. The diverter 220 has a deflector 223 having a recess portion 230 of the guiding edge 228, which has a tapered shape and provides a cavity in the first trajectory 36 to the first receiving path 30, which is an additional space defined as indicated by the dotted line, virtually indicating a straight trajectory, and the guidance edge at the recess portion 230.

The guiding edge 228 further comprises a portion 229, which is arranged downstream of the recess portion 230, and which portion 229 is arranged substantially parallel to the first trajectory 36 to the first receiving path 30 between the shaft 222 and the first receiving path 30. A sheet advances along the first trajectory 36 to the first receiving path 30 in a direction as indicated by $R_2$. The recess portion 230 has a guiding part 231 having an acute angle $\alpha$ with respect to the direction $R_2$ of the sheet in the first trajectory 36 to the first receiving path 30, which is at most a maximum angle being 15°. In case the acute angle $\alpha$ is larger than 15°, leading edges of a sheet which are curved towards the guiding edge 228 may become obstructed in the first trajectory 36 to the first receiving path 30 due to the acute angle of the recess portion 230.

The recess portion 230 comprises an upstream part 233 relative to the sheet transport direction S (or direction $R_2$) having an acute angle $\beta$ away from the first trajectory 36 to the first receiving path 30. Said acute angle $\beta$ may be steeper than the acute angle $\alpha$, such as between 45° and 90°, as the upstream part of the recess portion 233 does not obstruct any leading edges of sheets moving along the first trajectory 36 to the first receiving path 30 in the direction $R_2$.

The recess portion 230 may additionally comprise a base part arranged between the upstream part 233 and the guiding part 231, wherein said base part is directed substantially parallel to the first trajectory 36 to the first receiving path 30.

Figure 5A:
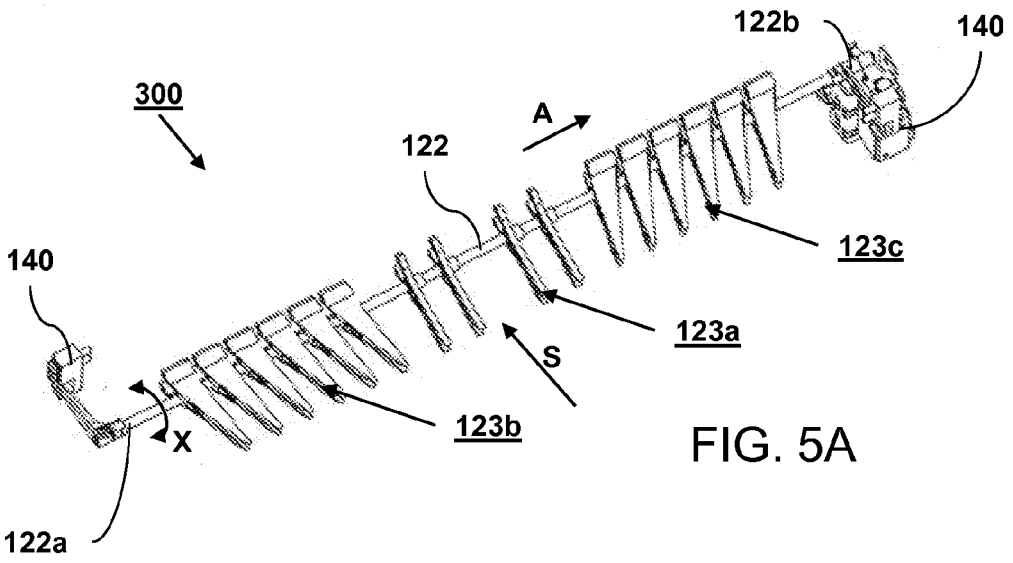
FIGS. 5A-5B show a perspective view and a plane view respectively of a sheet diverting unit according to an embodiment of the present invention.
Figure 5B:
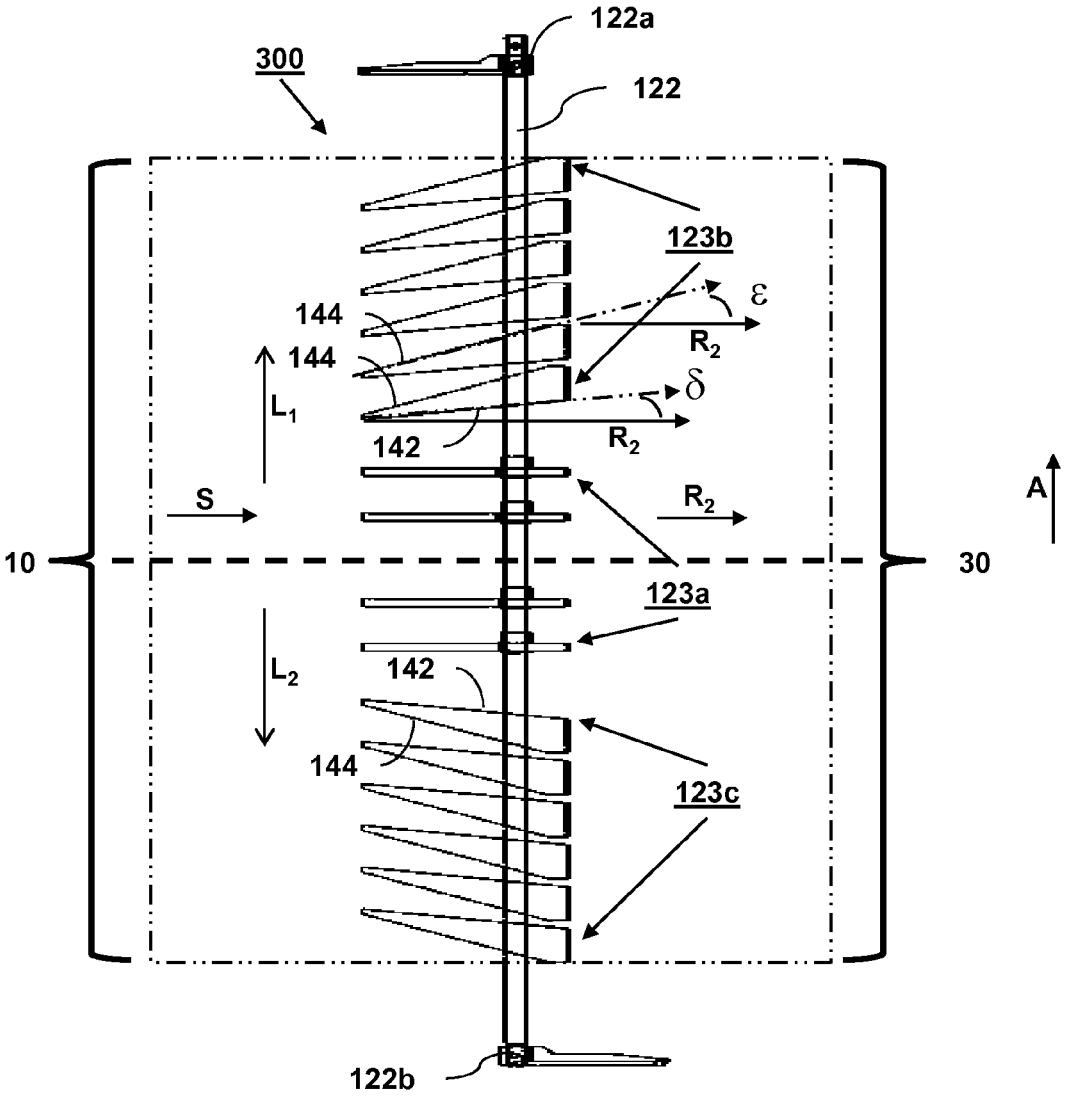

FIGS. 5A-5B show a perspective view and a plane view respectively of a sheet diverting unit according to an embodiment of the present invention.

Now referring to FIG. 5A the diverter of the sheet diverting unit 300 comprises a shaft 122. Said shaft 122 has an axial direction A which extends perpendicular to a sheet transport direction S. A plurality of deflectors 123*a*, 123*b*, 123*c* which are distributed along said shaft 122. Each of the plurality of deflectors 123*a*, 123*b*, 123*c* has a curved edge and a guiding edge including a recess portion as shown in FIG. 3C. Further each of the plurality of deflectors 123*a*, 123*b*, 123*c* are plate like structures having a first side surface 142 and a second side surface 144 arranged at both sides of the deflector 123 in an axial direction A of the shaft 122.

An actuator 140 is arranged at both ends of the shaft 122*a*, 122*b* for controllably rotating the shaft 122 in a direction X, thereby selectively pivoting the deflectors 123*a*, 123*b* and 123*c* between a second deflector position (as shown in FIG. 3B) for directing the sheet 2 into a second receiving path 20 and a first deflector position (as is shown in FIG. 3A) for directing the sheet 2 into a first receiving path 30. Each of the deflectors 123*a*, 123*b*, 123*c* have a guiding edge comprising a recess portion, for example as shown in FIG. 3C or as shown in FIG. 4. The recess portions of the plurality of deflectors 123*a*, 123*b*, 123*c* are substantially aligned in the axial direction A such that a trailing edge of an outgoing sheet is not obstructed by any of the deflectors 123*a*, 123*b*, 123*c* in the second deflector position.

Now referring to FIG. 5B a first set of deflectors 123*a* is arranged in a middle portion of the shaft 122 relative to the axial direction A. In each of said first set of deflectors 123*a* both side surfaces 142, 144 are arranged substantially parallel to the sheet transport direction S.

A second set of deflectors 123*b* is arranged in a lateral portion of the shaft 122 in a direction $L_1$ relative to the axial direction A to a first end of shaft 122. In each of said second set of deflectors 123*b* both side surfaces 142, 144 are arranged at an acute angle δ, ϵ respectively with respect to the sheet transport direction S, wherein a first acute angle δ of said first side surface 142 is smaller than a second acute angle ϵ of said second side surface 144 facing towards an end of the shaft 122 in the axial direction A.

A third set of deflectors 123*c* is arranged in a lateral portion of the shaft 122 in a direction $L_2$ relative to the axial direction A to another end of shaft 122 opposite to the first end of shaft 122. In each of said second set of deflectors 123*c* both side surfaces 142, 144 are arranged at an acute angle δ, ϵ respectively with respect to the sheet transport direction S, wherein a first acute angle δ of said first side surface 142 is smaller than a second acute angle ϵ of said second side surface 144 facing towards an end of the shaft 122 in the axial direction A.

In an example the first acute angle δ is about 5-15° and the second acute angle ϵ is about 20-30°.

Both side surfaces 142, 144 of the second and third set of deflectors 123*b*, 123*c* reliably guide side edges of sheets moving through the sheet diverting unit 200 from the inlet path 10 towards either one of the second receiving path 20 or the first receiving path 30.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the present invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet diverting unit for selectively diverting a sheet towards a first receiving path or a second receiving path, comprising:

an inlet path arranged for advancing a sheet in a sheet supply direction towards a diverter, wherein the diverter comprises a shaft, a deflector connected to said shaft and comprises a tip and an actuator arranged for rotating the shaft, thereby selectively pivoting the deflector between a first deflector position for directing the sheet into the first receiving path and a second deflector position for directing the sheet into the second receiving path, wherein said deflector comprises a guiding edge and a second edge, said second edge is arranged to face a second sheet trajectory from the inlet path to the second receiving path in the second deflector position for directing the sheet into the second receiving path and said guiding edge is arranged to face a straight first sheet trajectory from the inlet path to the first receiving path thereby said guiding edge faces a guiding element in the first deflector position for guiding the sheet into the first receiving path, wherein the guiding edge is an edge of the deflector and comprises two straight portions and a recess portion in the form of a cavity between the straight portions in the sheet supply direction and, when the deflector is arranged in the first deflector position, the straight portions extend in the sheet supply direction parallel to the straight first sheet trajectory and the recess portion extends inwardly away from the straight portions to the interior of the deflector, wherein when the deflector is arranged in the second deflector position, the recess portion extends substantially from the guiding element towards the shaft of the deflector.

2. The sheet diverting unit according to claim 1, wherein the recess portion accommodates a trailing edge of an outgoing sheet inside the first receiving path while the diverter is rotated about the shaft towards the second diverting position, thereby allowing a reduction in distance between successive sheets.

3. The sheet diverting unit according to claim 1, wherein the second edge is a curved edge arranged for deflecting the sheet into the second receiving path.

4. The sheet diverting unit according to claim 1, wherein the guiding element is a baffle.

5. The sheet diverting unit according to claim 1, wherein the straight portions are arranged substantially parallel to the guiding element of the straight first sheet trajectory to the first receiving path when the deflector is arranged in the first deflector position.

6. The sheet diverting unit according to claim 1, wherein the recess portion is shaped having an acute angle being not larger than 15° with respect to the first sheet trajectory to the first receiving path when the deflector is arranged in the first deflector position.

7. The sheet diverting unit according to claim 1, wherein the tip comprises a front edge arranged at an acute angle being at most 30° with respect to the guiding edge.

8. The sheet diverting unit according to claim 1, wherein the diverter of the sheet diverting unit comprises a plurality of deflectors distributed along an axial direction of the shaft, each deflector comprising said guiding edge arranged facing the first sheet trajectory to the first receiving path in the first deflector position for guiding the sheet into the first receiving path.

9. The sheet diverting unit according to claim 8, wherein each deflector has a first side surface and a second side surface arranged at both sides of the deflector in an axial direction of the shaft, wherein both first and second side surfaces of at least one of the plurality of deflectors are arranged at an acute angle away from the sheet supply direction.

10. The sheet diverting unit according to claim 9, wherein a first acute angle of said first side surface is smaller than a second acute angle of said second side surface facing towards an end of the shaft in the axial direction.

11. The sheet diverting unit according to claim 1, wherein the guiding edge is arranged along the shaft at a distance between the guiding edge and the shaft, which is at least a predetermined distance for guiding the sheet away from the shaft.

12. The sheet diverting according to claim 3, wherein the curved edge has a radius of at least 100 mm.

13. A printing system for printing on a sheet comprising a transport path for transporting said sheet along a printing station arranged for printing on said sheet, said transport path comprising a sheet diverting unit according to claim 1.

14. A sheet handling device comprising a transport path for transporting successive sheets through the sheet handling device, said transport path comprising a sheet diverting unit according to claim 1.

15. A sheet diverting unit for selectively diverting a sheet towards a first receiving path or a second receiving path, comprising:

an inlet path arranged for advancing a sheet in a sheet supply direction towards a diverter, wherein the diverter comprises a shaft, a deflector connected to said shaft and comprises a tip, and an actuator arranged for rotating the shaft, thereby selectively pivoting the deflector between a first deflector position for directing the sheet into the first receiving path and a second deflector position for directing the sheet into the second receiving path, wherein said deflector comprises a guiding edge and a second edge, said second edge is arranged to face a second sheet trajectory from the inlet path to the second receiving path in the second deflector position for directing the sheet into the second receiving path and said guiding edge is arranged to face a straight first sheet trajectory from the inlet path to the first receiving path thereby said guiding edge faces a guiding element in the first deflector position for guiding the sheet into the first receiving path, herein the guiding edge is an edge of the deflector and comprises two straight portions and a recess portion in the form of a cavity extending inward from the straight portions to an interior of the deflector, wherein the recessed portion is between the two straight portions in the sheet supply direction and, when the deflector is arranged in the first deflector position, the straight portions extend parallel to the straight first sheet trajectory, and wherein when the deflector is arranged in the second deflector position, the recess portion extends substantially from the guiding element towards the shaft of the deflector.

16. The sheet diverting unit according to claim 15, wherein the recess portion accommodates a trailing edge of an outgoing sheet inside the first receiving path while the diverter is rotated about the shaft towards the second diverting position, thereby allowing a reduction in distance between successive sheets.

* * * * *